United States Patent [19]

Voorheis

[11] Patent Number: 4,511,325

[45] Date of Patent: Apr. 16, 1985

[54] SYSTEM FOR THE REDUCTION OF $NO_x$ EMISSIONS

[75] Inventor: Temple S. Voorheis, Atherton, Calif.

[73] Assignee: Coen Company, Inc., Burlingame, Calif.

[21] Appl. No.: 446,755

[22] Filed: Dec. 3, 1982

Related U.S. Application Data

[62] Division of Ser. No. 240,663, Mar. 5, 1982, abandoned.

[51] Int. Cl.[3] ..... F23N 3/00

[52] U.S. Cl. ..... 431/10; 431/8; 431/12

[58] Field of Search ..... 431/8, 10, 12

[56] References Cited

U.S. PATENT DOCUMENTS

| | | | |
|---|---|---|---|
| 3,890,084 | 6/1975 | Voorheis et al. | 431/10 |
| 4,060,376 | 11/1977 | Perédi | 432/24 |
| 4,403,941 | 9/1983 | Okiura et al. | 431/10 |

*Primary Examiner*—Samuel Scott
*Assistant Examiner*—Allen J. Flanigan
*Attorney, Agent, or Firm*—Townsend and Townsend

[57] ABSTRACT

To minimize $NO_x$ emissions in an intermediate size industrial boiler furnace having two vertically spaced rows of burners, each upper burner has a central fuel nozzle and a main air opening adjacent to the nozzle and communicating with a wind box associated with the furnace. In addition, each upper burner has a plurality of air delivery ports through the wall surrounding said upper burner, such air delivery ports also communicating with the wind box. The air delivery ports can be of different sizes and shapes and can be at different angles with respect to the vertical plane of the wall through which the air delivery ports extend. Control of the air through the main air opening adjacent to the nozzle of each upper burner is achieved by one or more shiftable registers or dampers which operate to close the air flow from the wind box to the air opening. Each lower burner has the same construction as each upper burner except that the lower burner does not have the air delivery ports through the wall surrounding the nozzle and its adjacent main air opening. Typically, each lower burner is fired off-stoichiometrically with only about 70% theoretical air and each upper burner is fired with about 90% theoretical air, the make-up air for each upper burner coming through the air delivery ports arranged around it. The air delivery ports also provide the makeup air for the excess fuel through the lower burners. The air pressure of the air across the air delivery ports has a higher pressure than the air pressure across the main air openings adjacent to the fuel nozzles. This assures that the make-up air through the surrounding air delivery ports will penetrate deeply into the combustion chamber of the furnace.

7 Claims, 5 Drawing Figures

SYSTEM FOR THE REDUCTION OF $NO_x$ EMISSIONS

This is a division of application Ser. No. 240,663, filed Mar. 5, 1982, now abandoned.

This invention relates to improvements in industrial furnaces, and more particularly, to apparatus and a method for controlling the amount of $NO_x$ emissions from the furnace.

BACKGROUND OF THE INVENTION

Emissions from intermediate size industrial boiler furnaces include oxides of nitrogen or $NO_x$ emissions which are undesirable because they pollute the atmosphere; thus, they are to be eliminated if at all possible. Attempts have been made in the past to reduce such emissions without sacrificing the operating efficiency of such a furnace, such as operating the burners of the furnace with a slightly excess amount of air, two stage firing and off-stoichiometric or bias firing of the burners, and by increasing the air supply in the furnace. Such attempts have been described in U.S. Pat. No. 3,890,084.

Other attempts have been made to solve this problem by firing the lower of a vertically spaced pair of burners with 70% air while the upper burner was fired with 160% air. All of the air to the burners was introduced through the burner throats and thereby mixed with the fuel which kept the flame relatively cold. Cold flames discourage the formation of $NO_x$ emissions. Thus, since in this arrangement there is such an abundance of excess air, substantial amounts of $NO_x$ were nevertheless generated. This was an improvement over earlier attempts because relatively less fuel was introduced into the furnace through the upper burner which had high $NO_x$ emissions as compared with the lower burner which had low or virtually no $NO_x$ emissions so that the overall $NO_x$ emissions were tolerable.

Another attempt to solve this problem has been to use an air delivery port above each pair of vertically spaced burners of a furnace. These air ports required a booster fan, a separate wind box and separate ducts to the wind box. This required considerable expense and a large modification to conventional furnace design.

Notwithstanding the foregoing, the $NO_x$ emissions still remain a problem and require further attempts to reduce them to a more tolerable level. Because of this, a need has arisen for further improvements in the furnace of the type described so that the emissions resulting from the combustion of fuel and air in the furnace has a reduced amount of $NO_x$ emissions.

SUMMARY OF THE INVENTION

The present invention satisfies the aforesaid need by providing improved apparatus and a method for reducing $NO_x$ emissions by controlling the air flow to the upper and lower burners of such a boiler furnace in such a manner to minimize the formation of $NO_x$ emissions in the combustion products from each of the upper and lower burners by having both of them fire with a deficiency of stioichiometric air. This is done in such a way that the upper burners fire only 40% of the fuel, fire typically with a 10% air deficiency while the lower burners which fire 60% of the fuel are fired with only 70% of stoichiometric air. In order to reduce the $NO_x$ emissions, staged addition of the balance of combustion make-up air for both upper and lower burners is introduced separately from the burners itself through a number of air delivery ports which are in the wall portion of the furnace surrounding the upper burner, the air ports being in fluid communication with the wind box which supplies also the normal air delivery to registers of both upper and lower burners. The make-up air from the air delivery ports can be aimed at the fuel rich flames from the lower burners while also supplying whatever additional air is required to complete the combustion of the fuel introduced through the upper burners. In this way, $NO_x$ emissions are further reduced over that obtainable with previous methods so that the resultant effluent from the furnace will have a decreased effect on the pollution of the atmosphere yet the efficiency of the furnace will not be substantially affected.

The primary object of the present invention is to provide apparatus and a method of minimizing $NO_x$ emissions from an industrial boiler furnace of the type having a pair of vertically spaced rows of burners wherein the burners are fired with a deficiency of air to provide fuel-rich flames in the combustion chamber of the furnace yet excess air is supplied through a plurality of air delivery ports extending through the wall surrounding each upper burner and aimed at the fuel-rich flame in the combustion chamber so as to complete the combustion of the fuel introduced through the upper and lower burners and at the same time to minimize the $NO_x$ emissions in the products of combustion without sacrificing the operating efficiency of the furnace.

Other objects of this invention will become apparent as the following specification progresses, reference being had to the accompanying drawings for an illustration of the invention.

IN THE DRAWINGS

Figure 1:
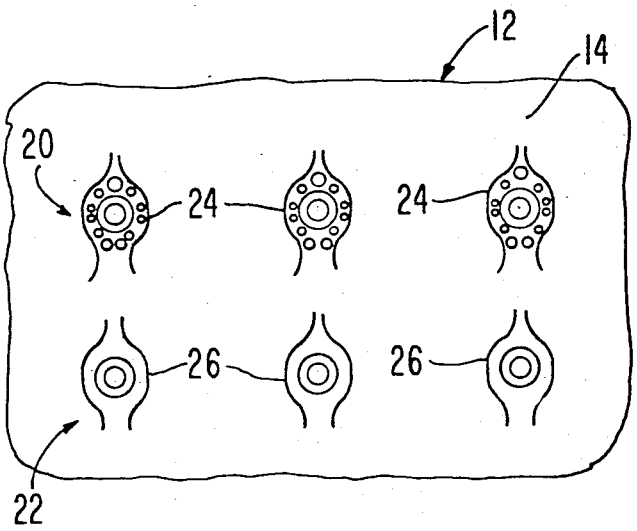
FIG. 1 is a side elevational view, in schematic form of two vertically spaced rows of burners mounted in a vertical side wall of a boiler furnace, showing the upper burners having a number of air delivery ports surrounding the central nozzle portions thereof.

The boiler furnace of the present invention is broadly denoted by the numeral 10 and includes a housing 12 having a pair of spaced, vertical side walls 14 and 16 and means 18 defining a stack for exhaust gases from the furnace. Wall 14 is a firing wall and has a pair of vertically spaced rows 20 and 22 of burners 24 and 26, each burner 24 being directly above a corresponding lower burner 26. The furnace can have any number of burners in each row and, since the present invention is especially suited for intermediate size furnaces, only two rows of burners will be used for the purposes of this invention.

Structurally, each of burners 24 and 26 may be dual air zone burners of the type shown in U.S. Pat. No. 4,201,539. In such a case, each burner has a burner throat 28 (FIGS. 3-5), a fuel injection nozzle 30 and a main air opening 31 surrounding nozzle 30. An air delivery register 32 is in fluid communication with main air opening 31 and with a wind box 34 defined by a pair of spaced walls 36 and 38. Air is supplied to main air oopening 31 surrounding nozzle 30 for combustion purposes from wind box 34 through air delivery passages which are controlled by dampers 40 and 42 and the positions of these dampers are, in turn, controlled by rods 44 and 46, respectively. The dampers control the air flow from wind box 34 through main air opening 31 of the burner and forwardly therefrom to a combustion region 48 in front of firing wall 14 in the boiler furnace. This air flow is indicated by arrows 50 (FIG. 5).

Figure 3:
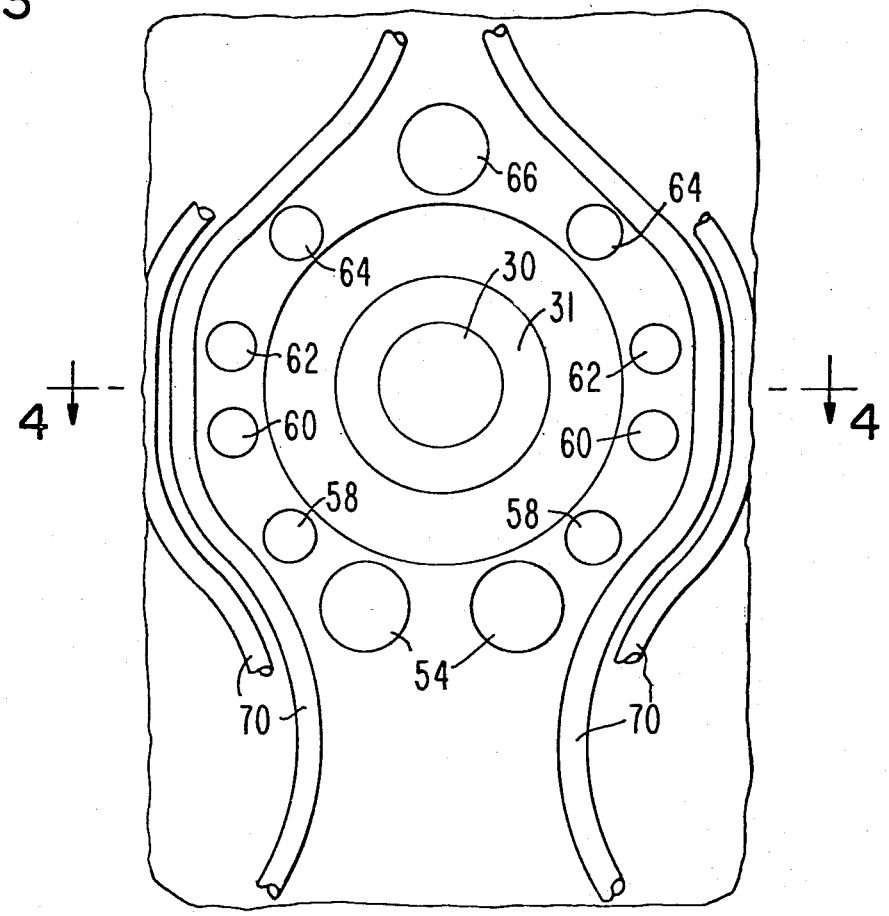
FIG. 3 is an enlarged front elevational view of one of the upper burners of the furnace.

Surrounding each upper burner 24, wall 14 has a plurality of holes or air delivery ports therethrough, these ports being laterally spaced from nozzle 30 and adjacent main air opening 31 of each upper burner 24. The air delivery ports place the interior of wind box 34 in fluid communication with combustion region 48 forwardly of the burner as shown in FIG. 5. The air delivery ports can be and typically are of different sizes. For instance, the lower pair of ports 54 are larger in size than intermediate ports 58, 60, 62 and 64. The upper port 66 is shown as being of the same size as ports 54 but can be larger or smaller, if desired. Moreover, all of the ports shown in FIG 3 are illustrated as being circular but they can be of other shapes if desired. For instance, some of the ports can be circular in cross-section while others can be of the other shapes, such as elliptical, square or the like. What determines the sizes and shapes of the ports are the amount of air to be delivered to region 48 and the location in region 48 to which the air is to be delivered.

Figure 5:
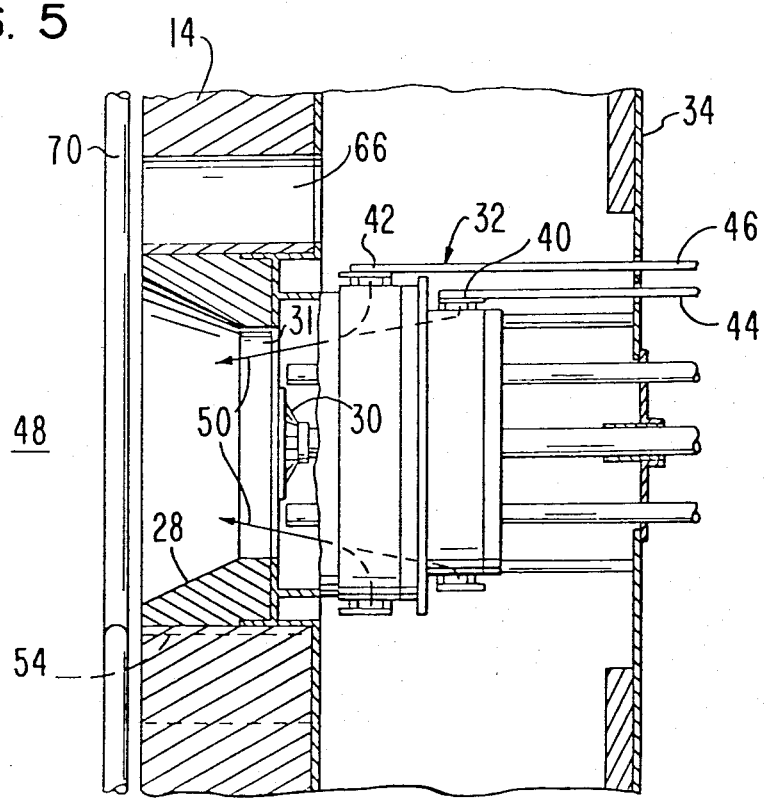
FIG. 5 is a vertical section of the burner taken along line 5—5 of FIG. 3.

As shown in FIG. 5, the air delivery ports are shown as being longitudinal axes which are generally perpendicular to the vertical plane of wall 14. However, some or all of the ports can be angled with respect to this plane.

Figure 4:
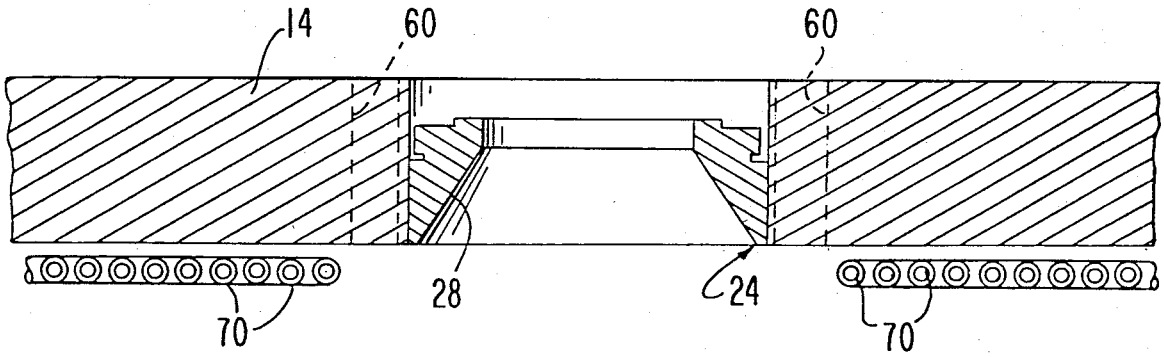
FIG. 4 is a cross-sectional view of the burner of FIG. 3, taken along line 4—4 of FIG. 3.

A plurality of vertically extending boiler tubes 70 are shown in FIGS. 3–5 adjacent to and along the inner surface of furnace wall 14. These boiler tubes carry water which is changed into steam by the heat generated by combustion of the air-fuel mixture in region 48 in advance of each of burners 24 and 26. Certain of these boiler tubes curve around the upper and lower burners as shown in FIGS. 1 and 3.

Figure 2:
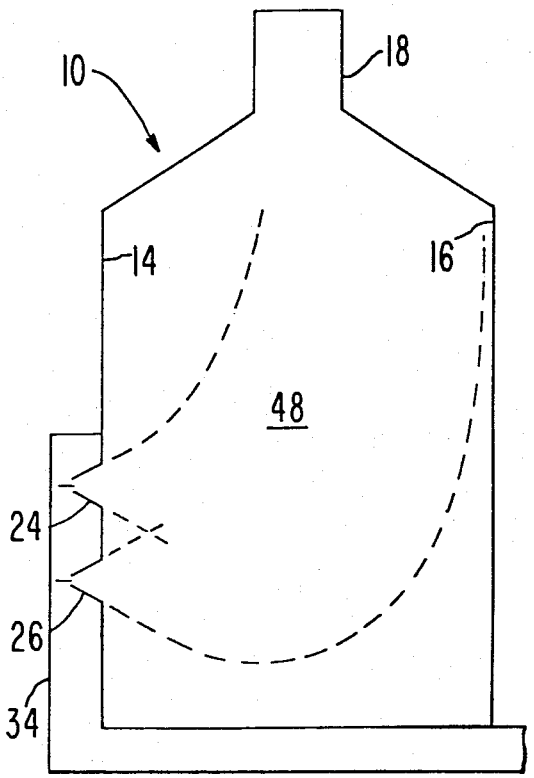
FIG. 2 is a schematic view of the furnace using the burners of FIG. 1 and showing the flame patterns associated with a pair of vertically spaced burners.

In operation, burners 24 and 26 are fired after first causing an air flow through wind box 34, as fuel is directed to nozzles 30 of the various burners, and as air is directed through main air openings 31 adjacent to the nozzles. Thus, combustion of the air and fuel in region 48 adjacent to the burners occurs to produce a flame front which heats by radiation and convection the water flowing through boiler tubes 70. The flame boundaries from the various upper and lower burners are denoted by dashed lines 80 and 82 (FIG. 2) and the combustion gases from the interior of furnace 10 exit from the furnace through stack 18. In the winding burners, the air flow through main air openings 31 thereof is controlled by the positions of slidable dampers 40 and 42 of burners 24 and 26. In the case of the upper burners 24, air flows not only through main air openings 31 adjacent to nozzles 30 of the burners, but also through the air delivery ports 54–66 ($NO_x$ ports). By reducing the fuel input to upper burners 24, a greater volume rate of flow of combustion air will issue with respect to the upper burners than with respect to the lower burners.

Generally, lower burners 26 will be off-stoichiometrically fired with sufficient air as to reduce stoichiometric air to only about 70%. This amount of air is controlled by slidable dampers 40 and 42 of the lower burners 26. Each upper burner 24 is fired with reduced fuel and air to provide only 90% of stoichiometric air through the burner throats but including the make-up air from the air delivery ports ($NO_x$ ports), the upper and lower burners operating overall with 10% excess air. The air delivery ports 54–66 ($NO_x$ ports) bring the overall air input to each upper burner to 150% before the air is discharged into the combustion chamber.

As each lower burner 26 operates with an oxygen deficiency, it is preferred to weigh the additional air applied around each upper burner so that a greater amount of air comes from the lower portion of each upper burner than from the upper portion thereof. This is accomplished by sizing, shaping and positioning the various ports 54–66 so that a greater number of ports or larger ports are nearer the lower portion of each burner 24.

It is important that the make-up air introduced through air delivery ports 54–66 have a sufficient pressure so that the air can penetrate deep into the combustion region 48. For this purpose, the fan pressure to the wind box is chosen to be as much as 7 to 9 inches of static water pressure. The upper and lower burner throats, on the other hand, require a substantially reduced air pressure differential. For each lower burner, which operates with only 70% of combustion air and assuming a 100% air firing with an air pressure of approximately 4 inches of static water pressure, the required air pressure differential across the burner throat is only about 2 inches of static water pressure while the required air pressure in each upper burner is only about 1.5 inches of static water pressure due to its reduced fuel input.

Each bottom burner can have a main air opening whose diameter is greater than the main air opening of the corresponding upper burner. Thus, the lower burner can carry a greater volume of air (even though a smaller percentage of that fuels stoichiometric air) without an excess differential between the differential air pressure requirements for both the upper and lower burners as determined by the positions of slidable dampers 40 and 42 of each burner.

The slidable dampers 40 and 42 of each of burners 24 and 26 are appropriately closed to throttle the combustion air delivered to air opening 31 and through the burner throats to the combustion region to the desired differential pressures. In this way, it is possible to avoid the need for a separate booster fan and its associated separate ducting which are both inconvenient and expensive. In this way, it is possible thereby to eliminate the need for separate wind boxes and ducts from the booster fan to additional separate air ports.

What is claimed is:

1. A method of controlling $NO_X$ emissions in the products of combustion of a boiler furnace having a pair of vertically spaced rows of burners comprising: firing each lower burner with a relatively large deficiency of air to provide a fuel-rich flame in the lower part of the combustion region of the furnace; firing each upper burner with a relatively small deficiency of air with the flame emanating from each upper burner combining with the flame emanating from a respective lower burner in said region; and directing a volume of air into the region to make up the deficiency of the air through the lower and upper burners, said volume of air being delivered along a number of paths adjacent to and spaced from each upper burner, respectively, certain of said air delivery paths being adjacent to the upper and lower portions of each upper burner, said directing step including moving a greater volume of air along the paths adjacent to the lower portion of each upper burner than is moved along the paths adjacent to the upper portion of the upper burner.

2. A method as set forth in claim 1, wherein each lower burner is fired with an air deficiency of approximately 30% and each upper burner is fired with an air deficiency of approximately 10%.

3. A method as set forth in claim 1, wherein at least certain of said air delivery paths are horizontal.

4. A method as set forth in claim 1, wherein at least one of the air delivery paths is inclined.

5. A method as set forth in claim 1, wherein each upper burner has a fuel nozzle and a burner throat adjacent to the first nozzle, the air pressure across the openings of said air delivery paths being greater than that of the air pressure across the burner throats adjacent to the fuel nozzles of said upper burners.

6. A method as set forth in claim 1, wherein each upper burner has a fuel nozzle and a main air opening surrounding the nozzle, there being a wind box for supplying air to said paths and each main air opening, said main air opening being in fluid communication with said wind box, said paths defining a number of air openings surrounding said burner and being separate from the main air opening of each upper burner.

7. A method as set forth in claim 6, wherein is included the step of controlling the flow of air from the wind box to the main air opening of each upper burner, respectively.

* * * * *